US007910816B2

(12) United States Patent
Glowacki

(10) Patent No.: US 7,910,816 B2
(45) Date of Patent: Mar. 22, 2011

(54) CIRCULAR PERCUSSIVE SOUND GENERATION INSTRUMENT

(76) Inventor: Stan C. Glowacki, Redondo Beach, CA (US)

( * ) Notice: Subject to any disclaimer, the term of this patent is extended or adjusted under 35 U.S.C. 154(b) by 0 days.

(21) Appl. No.: 12/432,561

(22) Filed: Apr. 29, 2009

(65) Prior Publication Data

US 2009/0272249 A1 Nov. 5, 2009

Related U.S. Application Data

(60) Provisional application No. 61/049,505, filed on May 1, 2008.

(51) Int. Cl.
*G10D 13/08* (2006.01)
*A63H 5/00* (2006.01)

(52) U.S. Cl. ..... 84/410; 84/406; 84/411 R; 446/419

(58) Field of Classification Search ..... 84/406, 84/410, 411 R; 446/419
See application file for complete search history.

(56) References Cited

U.S. PATENT DOCUMENTS

| | | | | | |
|---|---|---|---|---|---|
| 1,259,889 | A | * | 3/1918 | MacDonald | 446/409 |
| 2,247,873 | A | * | 7/1941 | Cohn | 446/419 |
| 2,318,460 | A | * | 5/1943 | Brief | 446/419 |
| 2,399,333 | A | * | 4/1946 | Desmond | 446/419 |
| 3,369,598 | A | * | 2/1968 | List | 165/90 |
| 3,384,990 | A | * | 5/1968 | Romand | 446/419 |
| 3,418,749 | A | * | 12/1968 | Ayala | 446/419 |
| 3,861,210 | A | * | 1/1975 | Griverus | 73/861.32 |
| 4,179,973 | A | * | 12/1979 | White | 84/402 |
| 4,215,510 | A | * | 8/1980 | Worrell | 446/28 |
| 4,306,485 | A | * | 12/1981 | Rudkin | 84/402 |
| 4,356,915 | A | * | 11/1982 | Phillips | 206/315.1 |
| 4,632,391 | A | * | 12/1986 | Orak | 482/110 |
| 4,901,617 | A | * | 2/1990 | Malone et al. | 84/402 |
| D335,554 | S | * | 5/1993 | Conner | D30/160 |
| 5,476,408 | A | * | 12/1995 | Hoeting et al. | 446/419 |
| 5,692,944 | A | * | 12/1997 | Pellicone | 446/170 |
| 5,738,560 | A | * | 4/1998 | Bears | 446/220 |
| 5,808,215 | A | * | 9/1998 | Kralik et al. | 84/402 |
| 6,005,749 | A | * | 12/1999 | Ikuta et al. | 360/99.12 |
| 6,099,444 | A | * | 8/2000 | Domenge | 482/110 |
| 6,146,236 | A | * | 11/2000 | Kay | 446/419 |
| 6,179,758 | B1 | * | 1/2001 | Domenge | 482/110 |

(Continued)

OTHER PUBLICATIONS

Coffee Can Drum, © 1996-2008, viewed Jul. 16, 2010 at http://www.rhythmweb.com/homemade/coffeecan.htm. Drum includes circumferential rings and may have beads inside at the maker's choice.*

(Continued)

*Primary Examiner* — Elvin G Enad
*Assistant Examiner* — Robert W Horn
(74) *Attorney, Agent, or Firm* — Felix L. Fischer

(57) ABSTRACT

A percussion instrument incorporates a case with an inner surface having a substantially circular profile. Multiple high precision spherical balls are contained with the case for acceleration on the inner surface in uniform circular motion along the profile to produce a persistent sustained sound. In one exemplary embodiment the case is cylindrical and incorporates two end plates. In a second embodiment the percussion instrument case is torroidal. In a third embodiment the percussion instrument case is spherical. Use of varying materials in the case or differing surface textures on the inner surface allows timbre of the instrument to be modified. Motion of the instrument lateral or perpendicular to the circular profile allows the creation of pulsed percussion sounds.

5 Claims, 15 Drawing Sheets

U.S. PATENT DOCUMENTS

| | | | | |
|---|---|---|---|---|
| 6,198,033 | B1 * | 3/2001 | Lovelett | 84/411 R |
| 6,346,664 | B1 * | 2/2002 | Shuen | 84/402 |
| D458,653 | S * | 6/2002 | Hsu | D21/662 |
| D462,098 | S * | 8/2002 | Fazeli | D21/662 |
| 6,450,854 | B1 * | 9/2002 | Fireman et al. | 446/236 |
| 6,500,102 | B1 * | 12/2002 | Domenge | 482/110 |
| 6,682,393 | B1 * | 1/2004 | Puett, III | 446/418 |
| 6,776,742 | B2 * | 8/2004 | Domenge | 482/110 |
| 6,858,787 | B1 * | 2/2005 | de Vries | 84/402 |
| D511,354 | S * | 11/2005 | Cohen | D17/22 |
| 7,037,243 | B1 * | 5/2006 | Clancy | 482/81 |
| 7,045,695 | B1 * | 5/2006 | Cohen | 84/402 |
| 7,152,862 | B1 * | 12/2006 | Chiu | 273/109 |
| 7,470,845 | B2 * | 12/2008 | Fermie et al. | 84/402 |
| 2001/0047715 | A1 * | 12/2001 | Rice | 84/402 |
| 2009/0272249 | A1 * | 11/2009 | Glowacki | 84/410 |

OTHER PUBLICATIONS

Review of the Remo Ocean Drum, Nov. 13, 2004, the drum has a shell and two heads with steel bead in between. viewed at http://drums-percussion.musiciansfriend.com/product/Remo-Ocean-Drum?sku=442463 on Jul. 16, 2010.*

* cited by examiner

CIRCULAR PERCUSIVE SOUND GENERATION INSTRUMENT

REFERENCE TO RELATED APPLICATIONS

This application claims priority of U.S. provisional application Ser. No. 61/049,505 filed on May 1, 2008 having the same title as the present application.

BACKGROUND OF THE INVENTION

1. Field of the Invention

This invention relates generally to percussion instruments for musical use and more particularly to a percussive instrument having a case with a circular or connected curve interior surface and multiple high precision balls carried within the case for persistent sound generation.

2. Related Art

A number of percussive instruments are available for pulsed or shaken sound such as maracas or shakers. U.S. Pat. No. 7,045,695 issued on May 16, 2006 to Cohen describes an exemplary instrument of this type. While having the potential for sound generation based on shaking or pulsing of the instrument resulting in multiple percussive impact of beads carried within the instrument, no potential for persistent sound is available. So called "rain sticks" allow a flow of beads through an orifice in a resonant tube to create a flowing or persistent sound, however the nature of the sound is not easily controllable for musical use.

It is therefore desirable to provide a percussive instrument which has the capability for providing pulsed beats as with a maraca but also allows generation of sound with natural persistence. It is also desirable that the instrument be capable of varied sound quality in the persistent sound generation mode.

SUMMARY OF THE INVENTION

The present invention provides a percussion instrument having a case with an inner surface having a substantially circular profile. One or multiple high precision spherical balls are contained with the case for acceleration on the inner surface in uniform circular motion along the profile to produce a persistent sustained sound. In one exemplary embodiment the case is cylindrical and incorporates two end plates. In a second embodiment the percussion instrument case is torroidal. In a third embodiment the percussion instrument is spherical. Use of varying materials in the case or differing surface textures on the inner surface allows timbre of the instrument to be modified. Motion of the instrument lateral or perpendicular to the circular profile allows the creation of pulsed percussion sounds.

A single instrument may be created by interconnection of multiple individual cases having differing numbers of balls or differing materials of construction.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1:
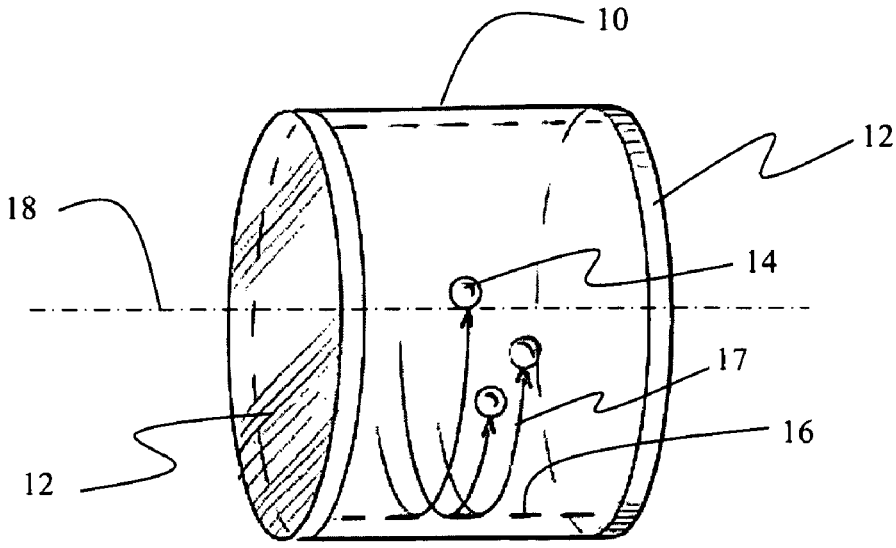
FIG. 1 is a partially sectioned pictorial view of a first embodiment of the invention.

Referring to the drawings, FIG. 1 shows an exemplary embodiment of the present invention employing a cylindrical case 10 having end plates 12. Multiple precision shaped highly spherical balls 14 are contained within the case and an inner surface 16 of the case provides a race for the balls as will be described in greater detail subsequently. For the initial embodiment shown, multiple balls are employed and the balls are shown of consistent size. However as will be described subsequently for alternative embodiments one larger ball or balls of multiple sizes may be employed. The balls can be made of varying materials such as metal, plastic or glass. In alternative embodiments the instrument includes a removable end plate or plug to allow varying numbers and sizes of balls to be interchangeably used within the instruments. Shaking the instrument, either substantially perpendicular to a central axis 18 of the cylinder or, alternatively perpendicular to the caps causes the balls to rebound off opposing surfaces with pulsed beat similar to that associated with maracas and similar instruments.

Alternatively, and most indicative of the present invention, the instrument is accelerated substantially tangentially to the circumference of the cylinder and uniform spherical motion of the balls, represented by arrows 17, is induced along the interior wall. This motion of the balls provides a very low resistance and a persistent sound is generated by multiple orbitals of the balls on the interior surface; producing a "swooshing", "whirring", "whizzing" or "buzzing" sound. The high precision spherical shaping of the balls allows the persistence of the sound to continue for an extended period. The sound may be terminated by imparting a lateral acceleration to lift the balls from the surface or by tilting the cylinder to spiral the balls to an end plate. As will be described in greater detail subsequently, alternative materials in the end plates or other distinct sections within the differing embodiments may be employed to alter the sound, mute the sound, or capture the balls to terminate the sound.

The two forms of sound generation are easily mixed by the percussionist by holding the cylinder in the hand using a lateral shaking for pulsed percussion and a flick of the wrist to induce the uniform circular motion. The embodiments of the instrument shown in the drawings comprise the basic case only. The case can also be mounted on a fixed or removable handle in alternative embodiments to increase the moment arm for inducing higher accelerations to the balls contained in the instrument both for the pulsed percussion created by moving the balls within the inner volume between surfaces and the uniform circular motion with the balls in contact with the inner surface for the persistent or sustained sound.

In alternative embodiments, the length of the cylinder my be less than its diameter to create a disc shaped instrument similar to a tambourine or lengthened to create a can shape providing greater interior surface on the wall and greater distance between end plates. The radius of the case of the instrument is sufficient for the uniform circular motion of the balls to be induced. The radius will range from a minimum of one inch to sizes up to and above 18 inches, depending on the shape of the embodiment and the size of the interior balls. The size of the balls in relation to the size of the embodiment is chosen to effect the timbre, the velocities, and the sustain of the instrument.

Figure 2A:
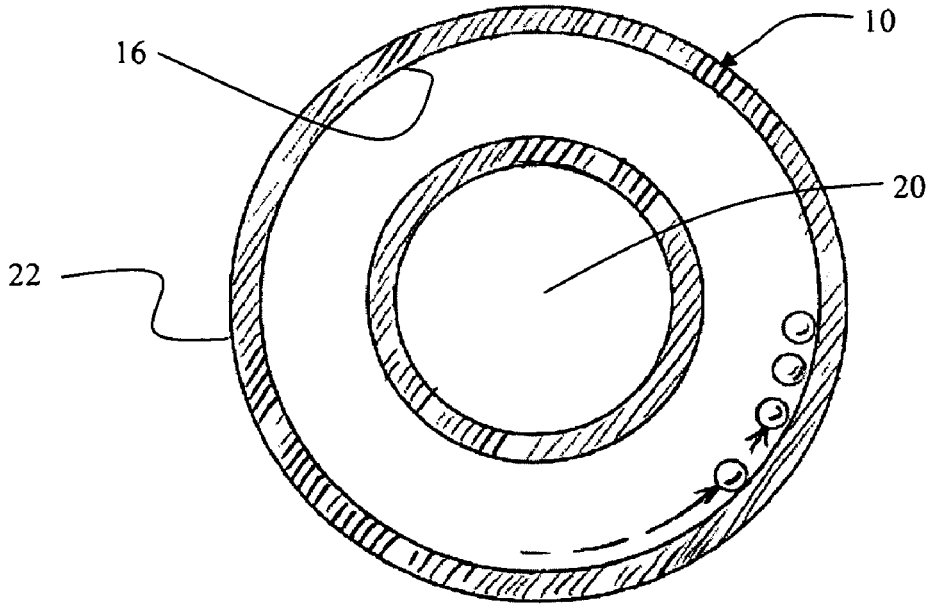
FIG. 2A is a side section view of a torroidal embodiment of the invention.
Figure 2B:
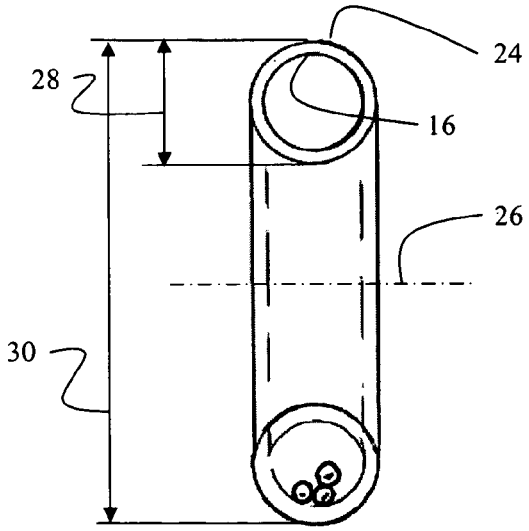
FIG. 2B is a front cross section view of one embodiment of the torroidal instrument shown in FIG. 2A.
Figure 2C:
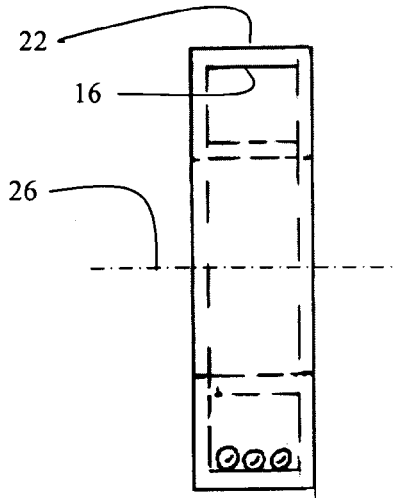
FIG. 2C is a front cross section view of a second embodiment of the torroidal instrument shown in FIG. 2.
Figure 2D:
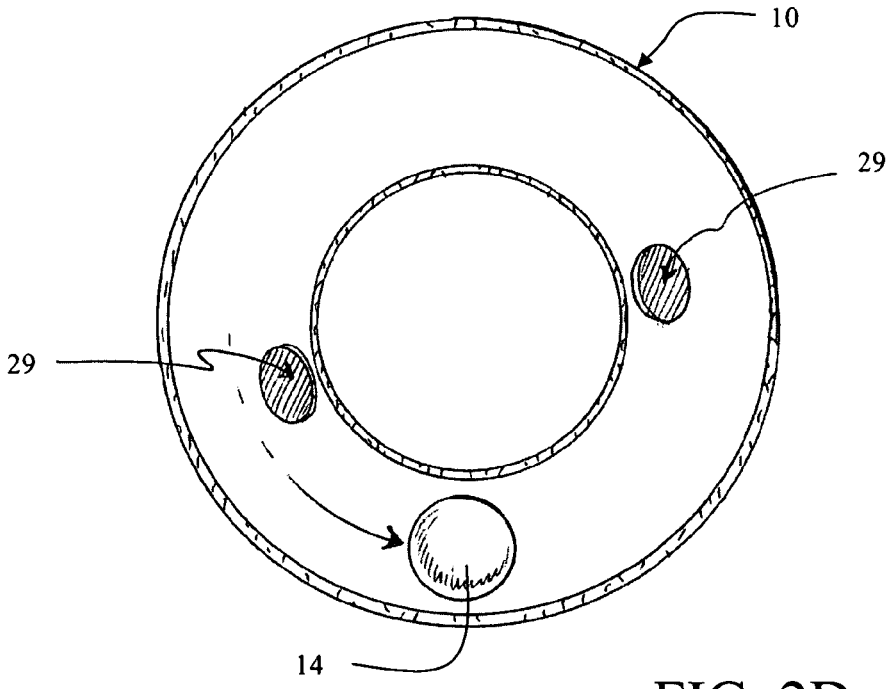
FIG. 2D is a side section view of the torroidal embodiment with a single large ball and vent apertures.
Figure 2E:
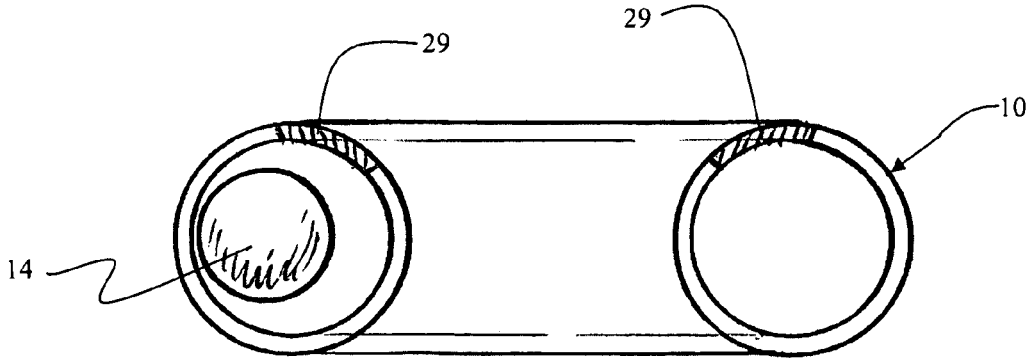
FIG. 2E is a front cross section view of the torroidal embodiment of FIG. 2D.

A second embodiment of the invention is shown in FIG. 2A wherein the case is torroidal in shape having a central aperture 20. As shown in FIGS. 2B and 2C, the torroidal version is alternatively a cylindrical walled instrument having a square or rectangular cross section with the outer wall 22 of the torroid providing the persistent sound generating inner surface 16 or a circular cross sectioned instrument with the outer hemisphere 24 providing the inner surface. The square cross-sectioned instrument maintains the end plate configuration allowing pulsed sound by motion induced perpendicular to the end surface. With either version, the pulsed maraca-like sound may be generated by motion of the instrument along a directional vector substantially through the center axis 26 with the persistent sound generation accomplished by motion of the instrument tangential to the outer circumference of the torroid to induce the uniform circular motion of the balls along the inner surface. Variation of the torroid depth 28 and overall diameter 30 in alternative embodiments allows modification of the resonant characteristics of the instrument. This embodiment could also be fitted with vent holes as shown in FIGS. 2D and 2E such that one or multiple balls, during uniform circular motion, will push air out of the vent holes 29 in rapid succession which produces a vibrato or tremolo sound, or a musical tone when the balls travel past the vents during multiple orbitals of uniform circular motion within the embodiment.

Figure 3A:
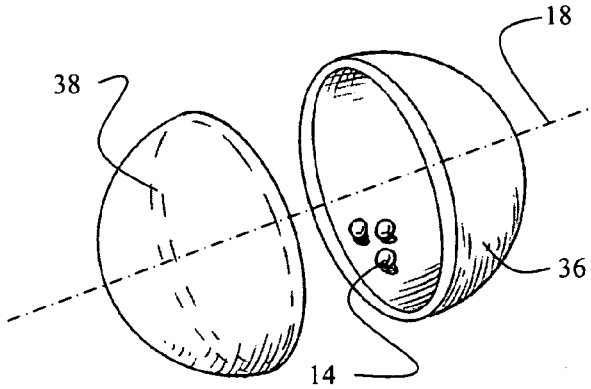
FIG. 3A is a ¾ exploded view of a spherical embodiment of the invention.
Figure 3B:
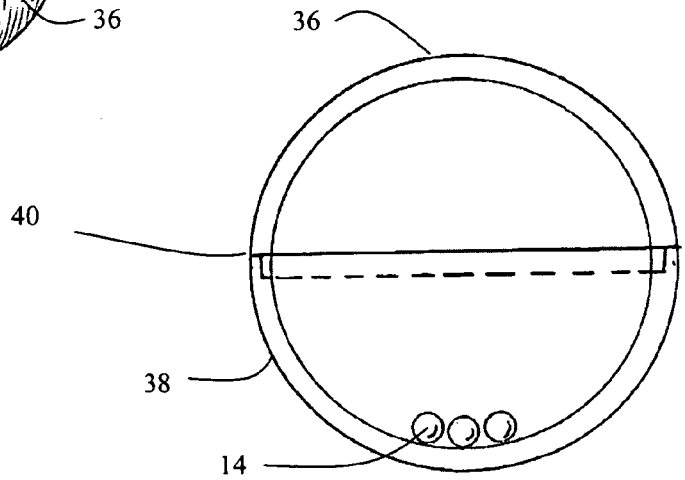
FIG. 3B is a cross section view of the spherical embodiment of the invention of FIG. 3A.

A third embodiment is shown in FIGS. 3A and 3B wherein the case is spherical. For the embodiment shown in the drawings, the sphere employs two hemispheres 36 and 38 separable on an equator 40 for insertion of balls 14. With the spherical embodiment, axis 18 is arbitrarily selectable and the chosen axis may be used to vary the timbre as will be described in greater detail subsequently.

Figure 4A:
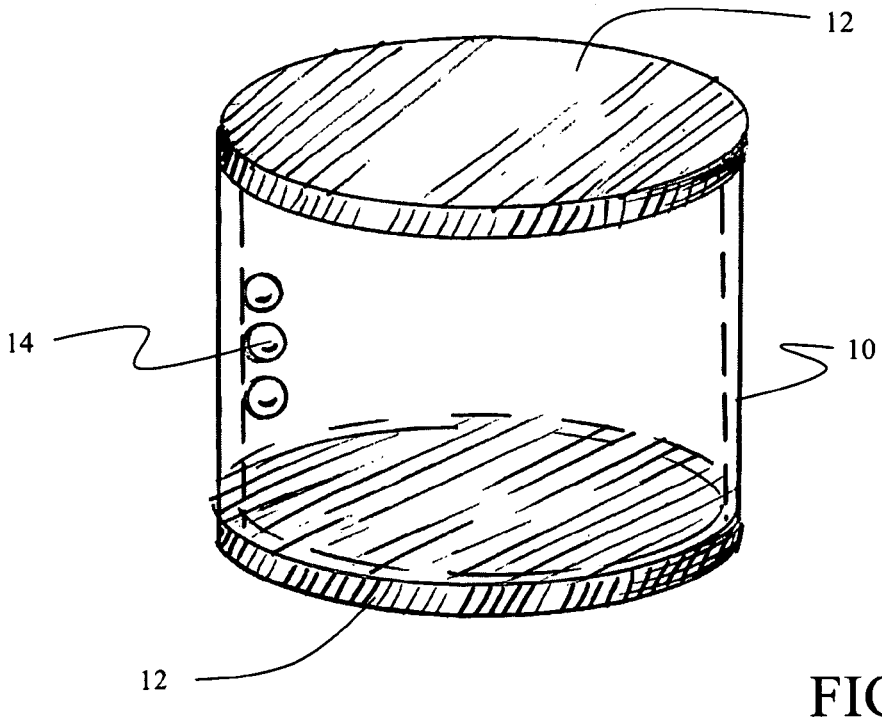
FIG. 4A is a phantom view of the embodiment of FIG. 1 employing alternative materials in the end caps.
Figure 4B:
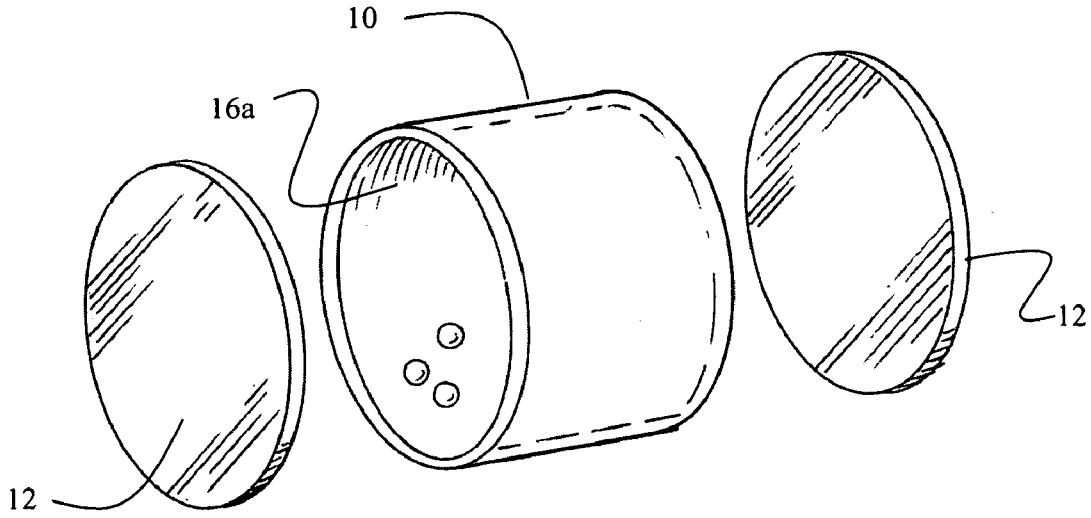
FIG. 4B is a ¾ exploded view of the embodiment of FIG. 1 employing alternative materials in the end caps.
Figure 4C:
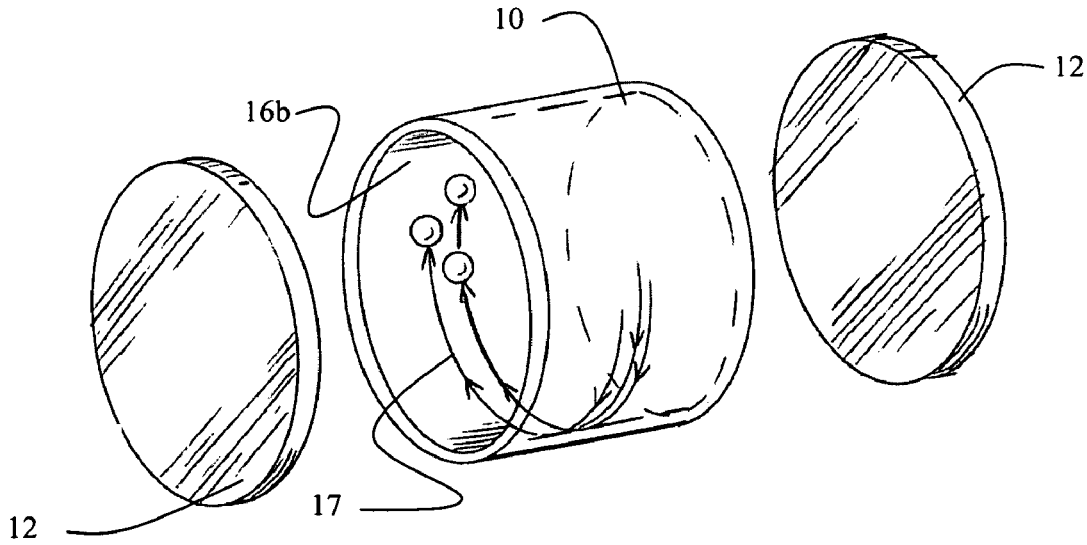
FIG. 4C is a ¾ view of the embodiment of FIG. 1 employing alternative materials in the end caps with the balls in uniform circular motion.

The embodiments of the instrument described may be fabricated from plastic, metal, mineral, various woods or frame supported diaphragms to create sounds with various timbre for both the shaken pulsed percussive sound and the persistent uniform circular motion sound. Varying combinations of material forms in the cylinder and end plates allows further tailoring of the desired sounds. As exemplary, the end plates of the cylindrical embodiment of FIG. 1 could be of differing types of plastics or of light laminated wood construction while the case cylinder is metal or plastic as shown in FIG. 4A-C. A first texture on inner surface 16*a* as shown in FIG. 4B will provide a different timbre than a second texture on inner surface 16*b* as shown in FIG. 4C when balls 14 are rotating in the orbitals represented by arrows 17. Alternatively, the end plates 12*a*, 12*b* and 12*c* may be of varying non-planar shapes as in FIGS. 4E-H. Alternatively the end plates are stretched diaphragms, like a drum head with the case cylinder fabricated from wood. Similar combinations may be employed for the square cross-sectioned torroidal embodiment. For the circular cross-sectioned torroidal instrument a plastic construction allows easy fabrication and is easily adaptable to various surface finishes.

Figure 4D:
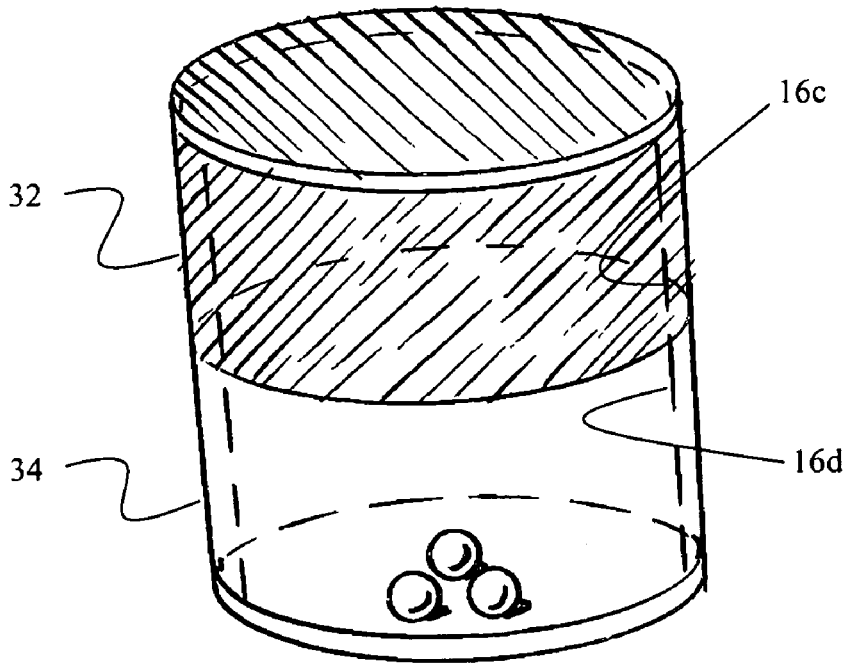
FIG. 4D is a phantom cross section view of an alternative interior surfacing of the embodiment of FIG. 1.
Figure 4E:
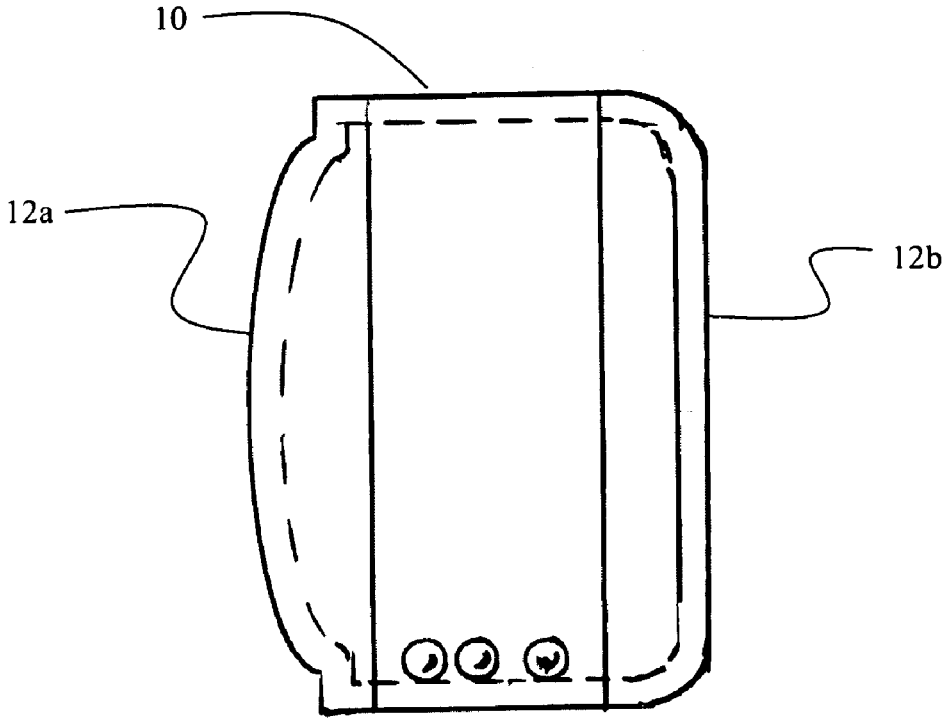
FIG. 4E is a phantom view of a first alternative embodiment showing different shaped end caps.
Figure 4F:
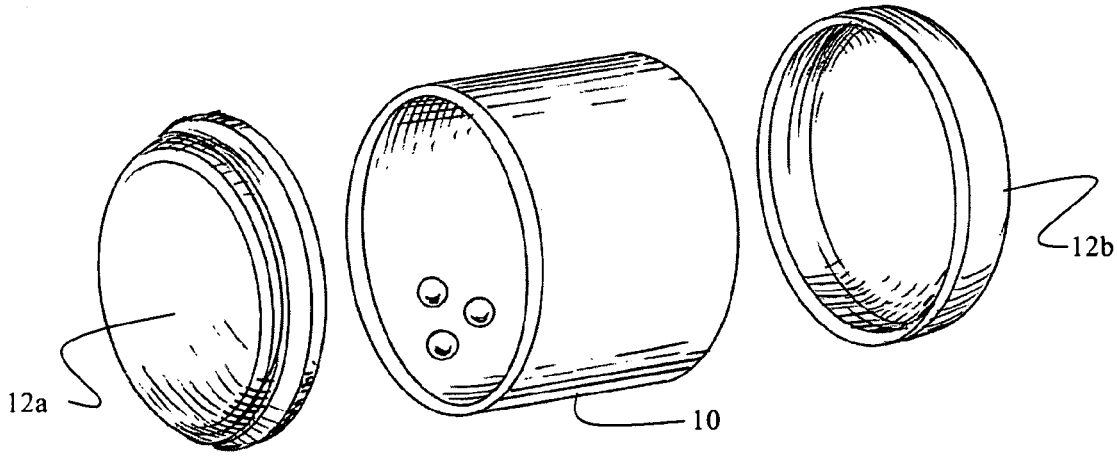
FIG. 4F is a ¾ exploded view of the embodiment of FIG. 4E with different shaped endcaps.
Figure 4G:
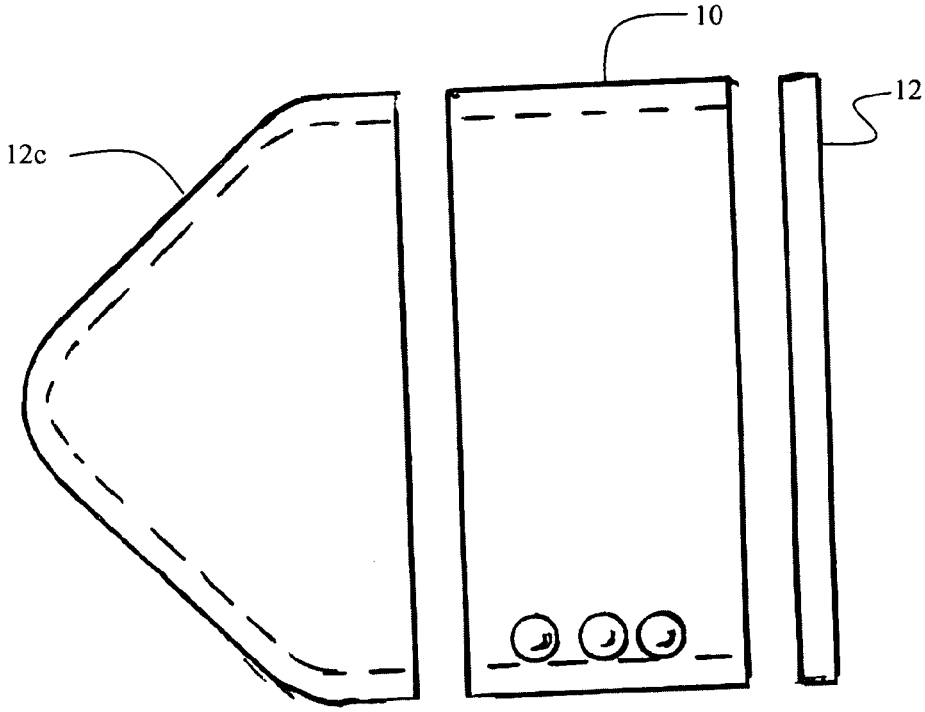
FIG. 4G is a phantom view of a second alternative embodiment with a cone-shaped endcap.
Figure 4H:
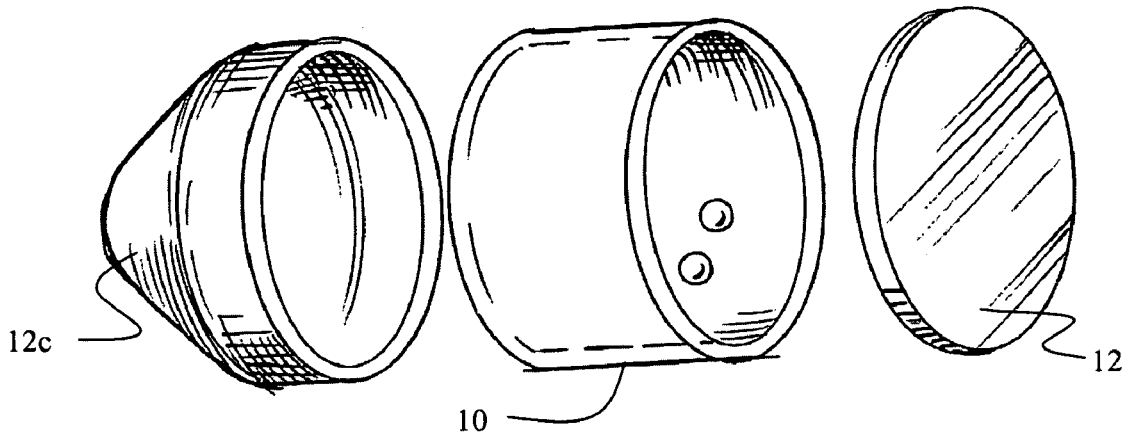
FIG. 4H is a ¾ exploded view of the embodiment in FIG. 4G with a cone-shaped endcap.

In addition to material types, the finish or texture of the inner surface 18 affects the timbre of the persistent sound. As shown in FIG. 4D, a combination of inner surface textures is created by combining a first cylinder portion 32 having a first inner surface texture 16*c* with a second cylinder portion 34 having a second inner surface texture 16*d*. The surface texture may be a function of the material selected for the cylinder portion. A combination of a wood portion with a metal portion provides very different timbres resulting from the balls rotating on that portion. In alternative embodiments, a single cylinder material is used with differing textures applied or machined into portions of the inner surface; as an example one portion having a smooth surface with a second portion having knurled surface.

With a multiple textured inner surface, the percussionist may create uniform circular motion on one portion or the other or with light lateral acceleration create a transition from one surface to the other by the rotating balls resulting in a change in timbre during the sustain.

Figure 3C:
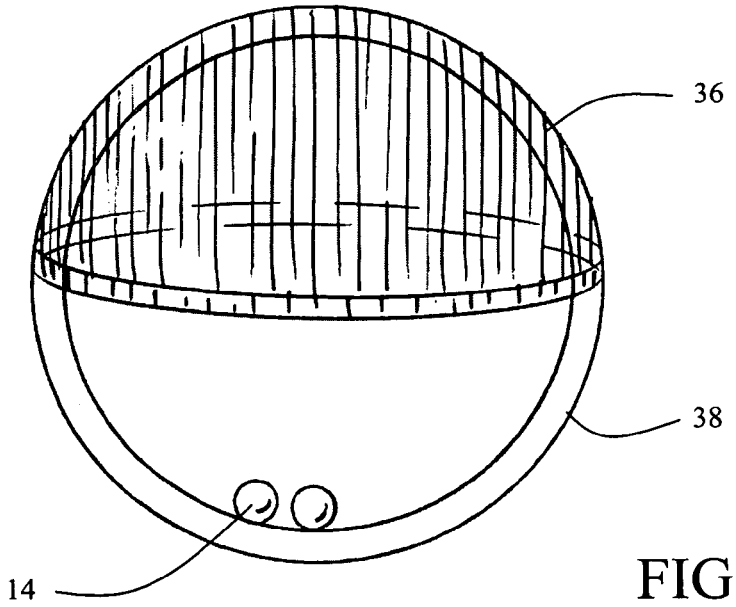
FIG. 3C is a phantom view of the alternative spherical embodiment of FIG. 3A with alternative surfacing.

FIG. 3C shows a spherical embodiment of the invention wherein first hemisphere 36 is a soft plastic while second hemisphere 38 is a hard plastic. With practice, the percussionist can initiate rotation of the balls within the sphere on only one hemisphere and by selecting the hemisphere, the timbre of the sound is changed. Alternatively, the balls can be accelerated across an equator 40 of the sphere resulting in a timed mixing of the timbres which can be characterized as a vibrato or tremolo.

Figure 5A:
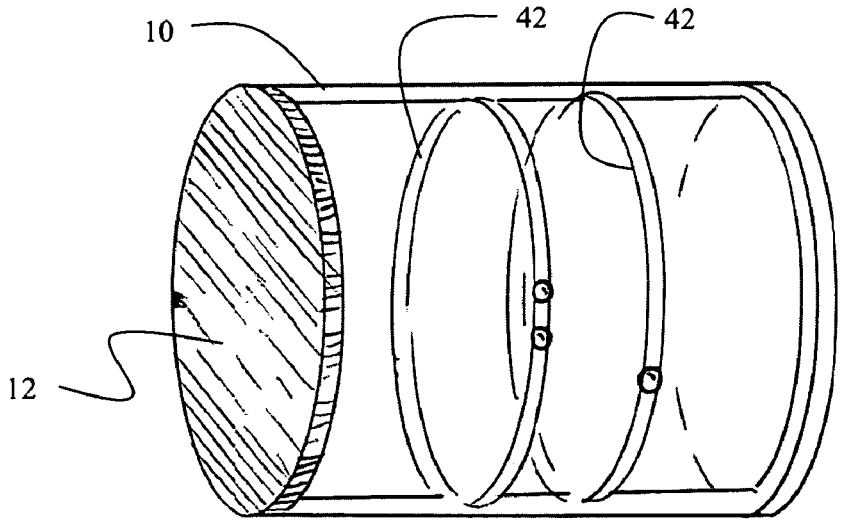
FIG. 5A is a phantom view of the embodiment of FIG. 1 with additional circumferential surface grooves.
Figure 5B:
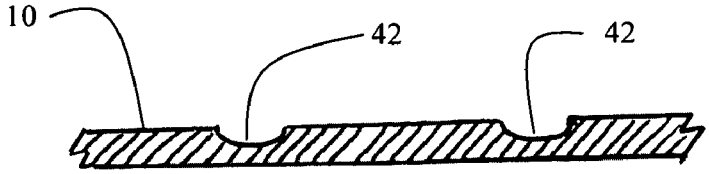
FIG. 5B is a partial section view of one side of the embodiment of FIG. 5A showing the grooves in detail.

An enhanced embodiment of the invention is shown in FIGS. 5A and 5B wherein concentric circumferential grooves 42 are incorporated in the inner surface. During the persistent sustain of the balls in uniform circular motion within the case minor lateral motion by the percussionist captures the balls within the grooves altering the timbre of the sound during the sustain. The number of grooves may vary and the grooves may have a surface texture differing from the base texture of the inner surface, either smoother or rougher, to further alter the effect of the timbre change.

Figure 6A:
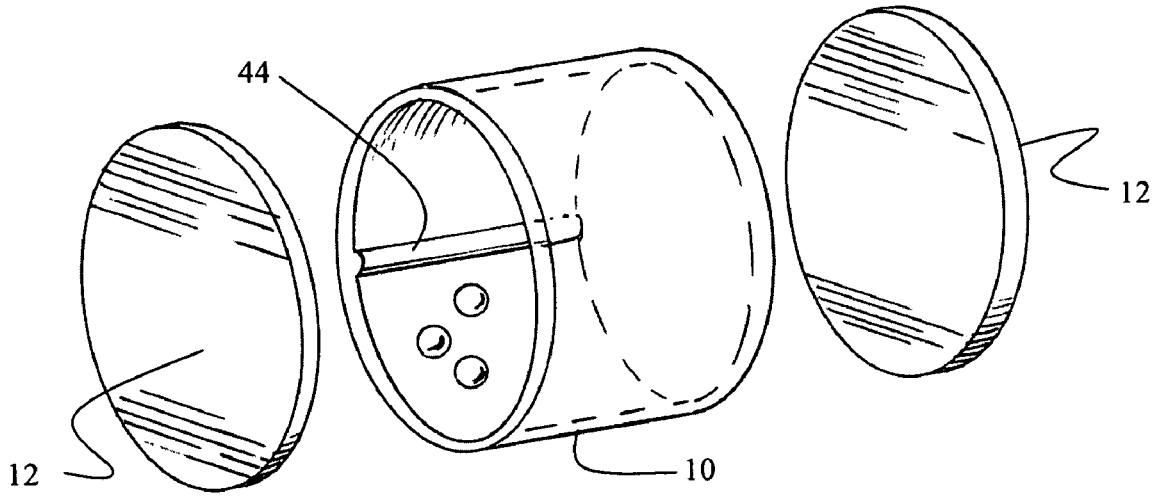
FIG. 6A is a ¾ view of a first interior surface treatment.
Figure 6B:
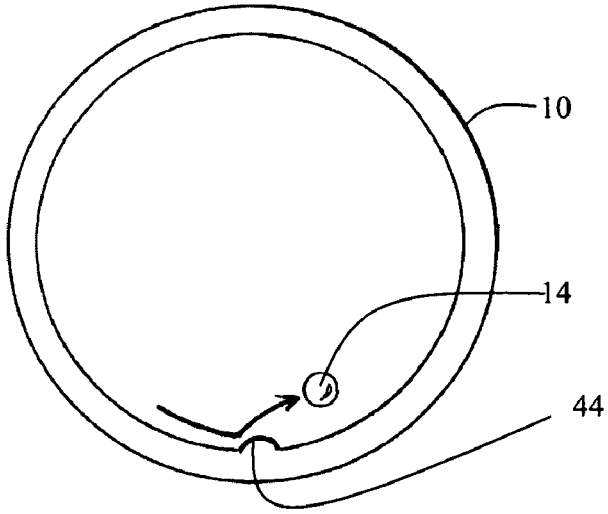
FIG. 6B is an end section view of a first interior treatment.
Figure 6C:
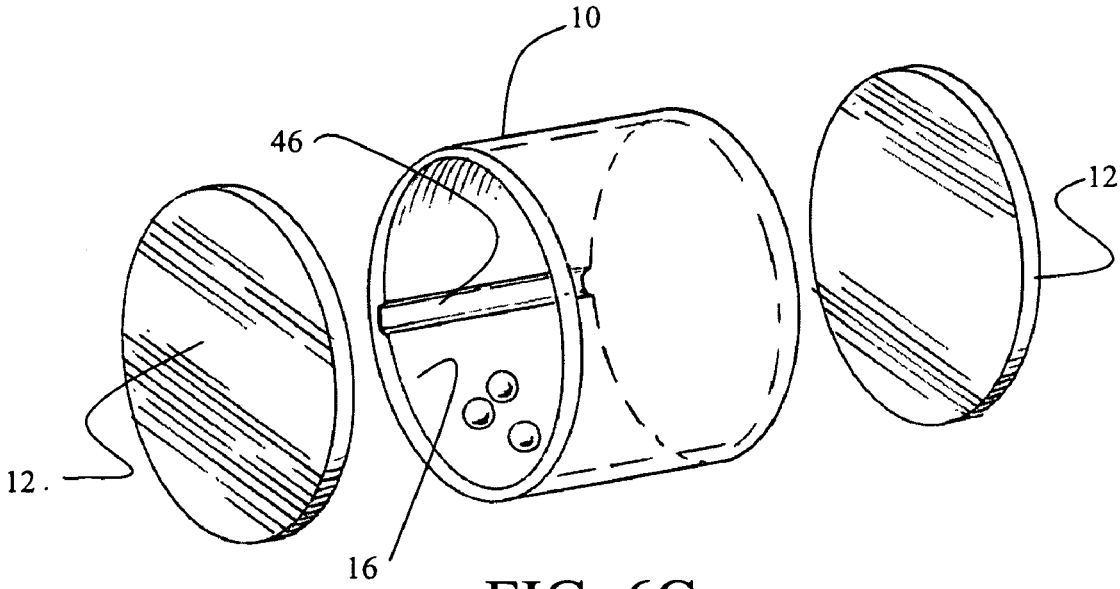
FIG. 6C is a ¾ exploded view of a second interior treatment.
Figure 6D:
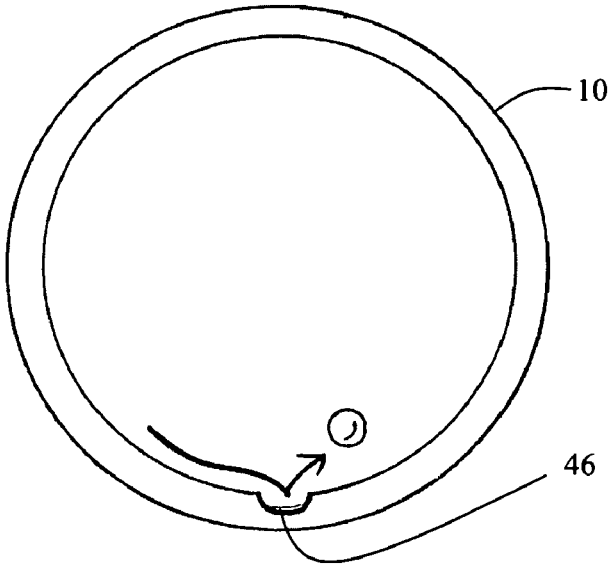
FIG. 6D is an end section view of a second interior surface treatment.
Figure 6E:
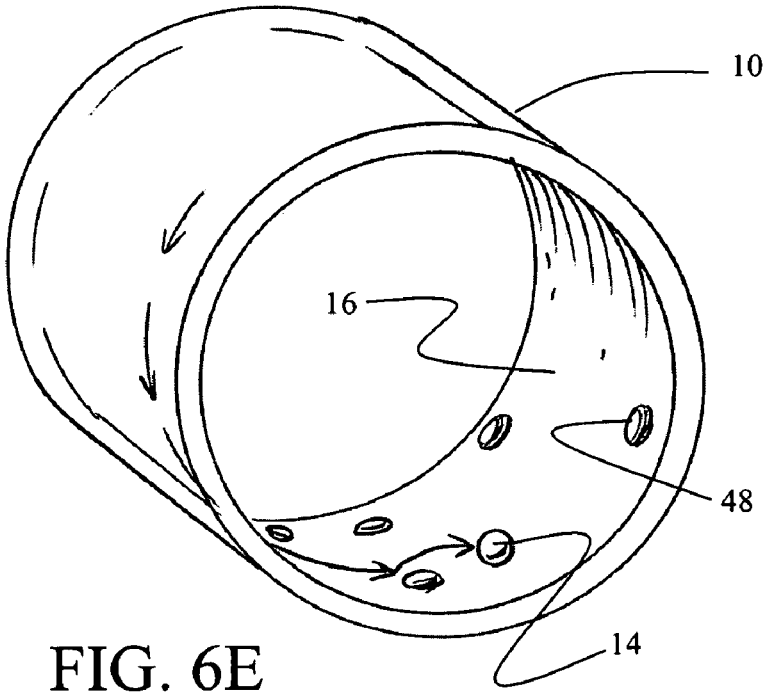
FIG. 6E is an isometric end view without endcaps of a third interior surface treatment.

Additionally, surface features transverse to the circumferential direction of the inner surface are employed in alternative embodiments for altering timbre of the generated persistent sustain. Ridges 44 such as that shown in FIGS. 6A and 6B create a jump or bounce in the balls as they pass over that feature during their circular motion on the inner surface. Similarly, grooves 46 as shown in FIGS. 6C and 6D create an interference with the circular motion which alters the timbre of the sustain. Individual bumps 48 on the inner surface as shown in FIG. 6E create a similar interference but only with a portion of the rotating balls. As with the material variance in the case, the surface features may be incorporated over the entire lateral length of the case or only a portion of the length to allow the percussionist to select the desired timbre effect.

Figure 6F:
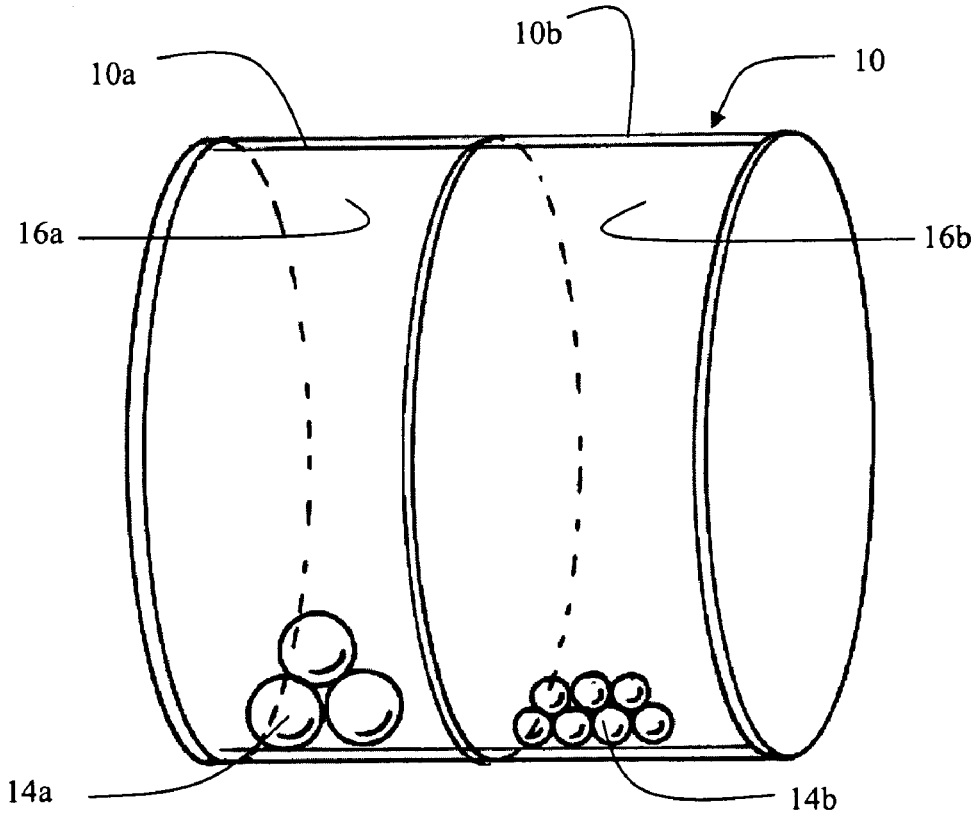
FIG. 6F is a phantom view of the embodiment of FIG. 1 with 2 chambers and balls within each chamber.
Figure 6G:
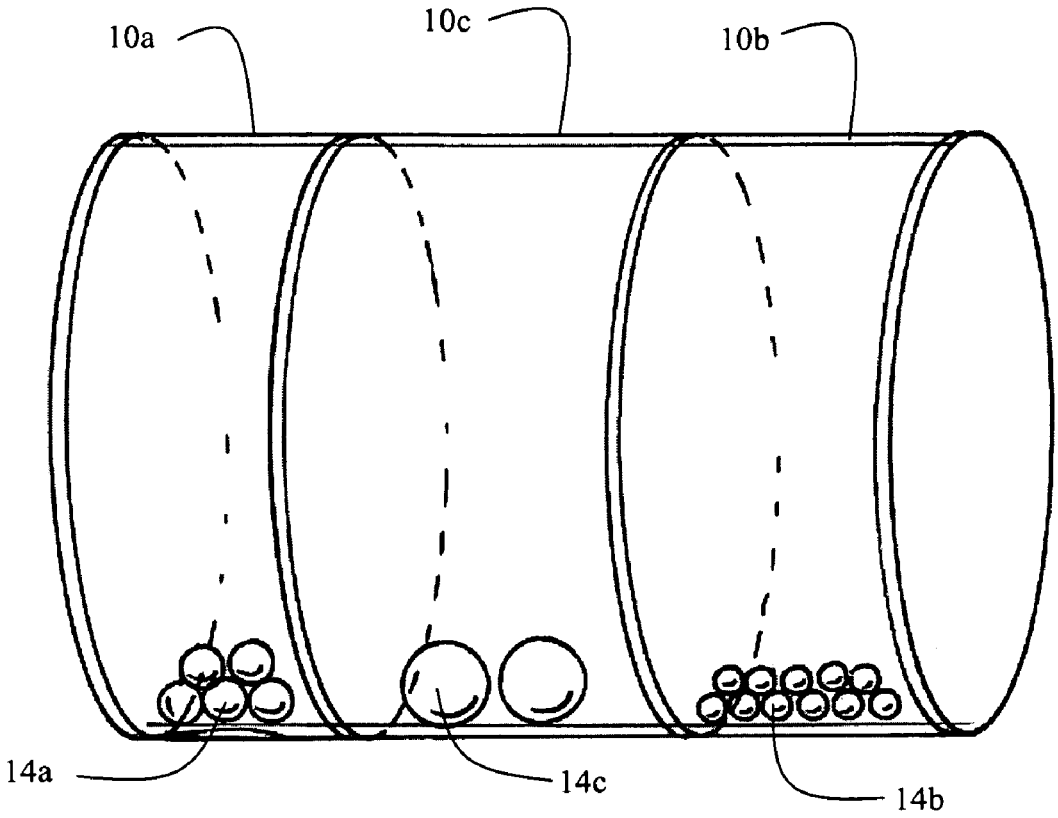
FIG. 6G is a phantom view of the embodiment of FIG. 1 with 3 chambers and balls within each chamber

Multiple chambers may be incorporated in a single instrument to provide varying combined sounds from differing materials, ball diameters or other effects. FIGS. 6F and 6G show exemplary embodiments of a two chambered and three chambered instrument. As seen in FIG. 6F, a double chambered instrument is created by combining in a single case 10 two chambers 10*a* and 10*b*, each chamber creating an instrument as shown in FIG. 1. Balls 14*a* of a first diameter in chamber 10*a* and balls 14*b* of a second diameter in chamber 10*b* create differing sounds. Similarly, differing interior surfaces 16*a* and 16*b* in chambers 10*a* and 10*b*, respectively, create yet additional sound variation in the overall instrument. FIG. 6G demonstrates an instrument adding yet a third chamber 10*c* with additional balls 14*c* of a third size. Variable combinations of ball sizes and ball numbers possible, as well as varying internal surface textures can produce multiple sounds on the same instrument.

Figure 7A:
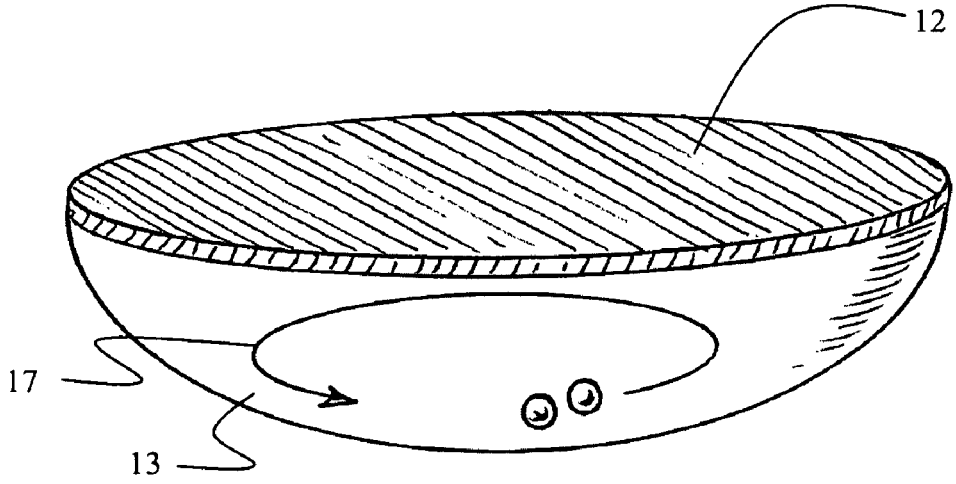
FIGS. 7A and 7B are pictorial views of alternative case shapes for the present invention.
Figure 7B:
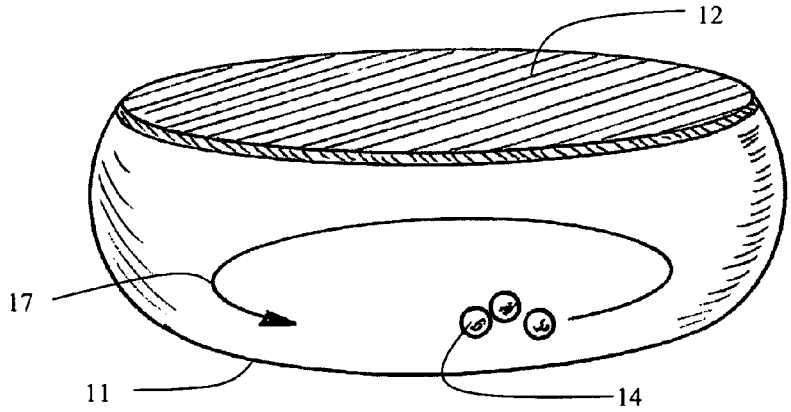
Figure 7C:
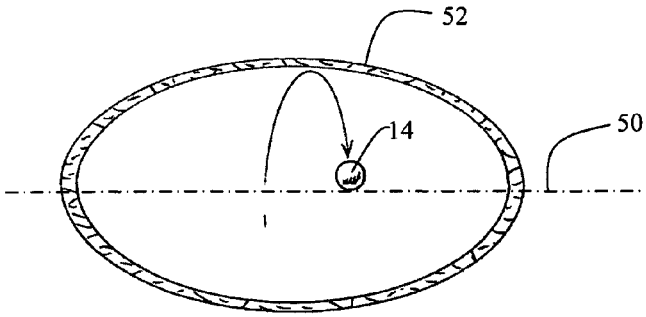
FIGS. 7C and 7D are side section views of alternative closed curves for the overall instrument shape.
Figure 7D:
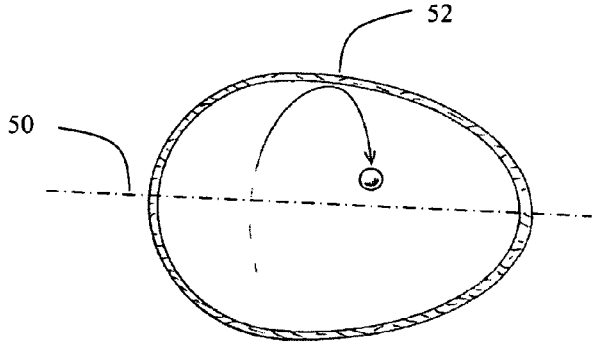

Alternative shapes of the overall instrument are employed in various embodiments such as bowl 11 or cup 13 shapes with one end plate 12 or various ellipsoids terminating in end plates or with curved terminations. Exemplary shapes for the instrument are shown in FIGS. 7A-7D. A circular profile for the inner surface 16 of the wall having a sufficient radius allows the highly uniform spherical balls retained in the interior of the instrument to be accelerated into uniform circular motion represented by arrows 17 for the generation of persistent sound is shown in FIGS. 7A and 7B. In the embodiments shown in FIGS. 7C and 7D, the case incorporates a partial paraboloid profile 52 having an axis of symmetry coinciding with the axis of the circular profile 50.

Figure 8A:
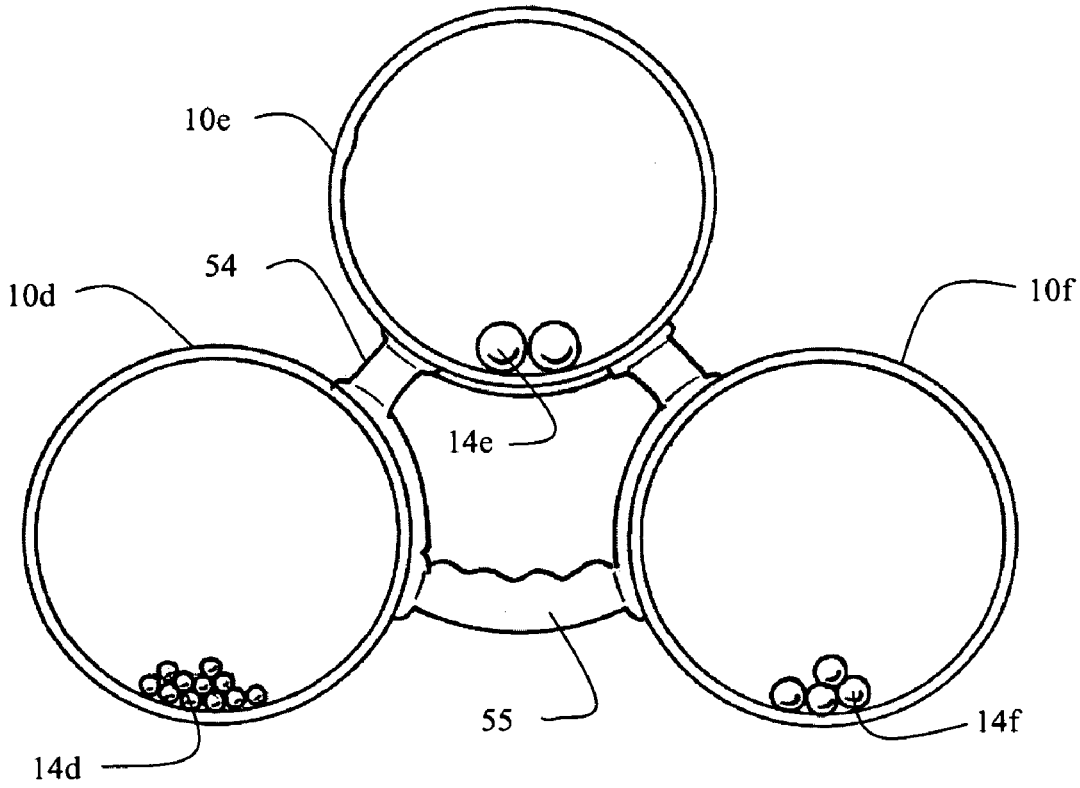
FIG. 8A is a end section view of three of the embodiments of FIG. 1 attached together to create a single unit.
Figure 8B:
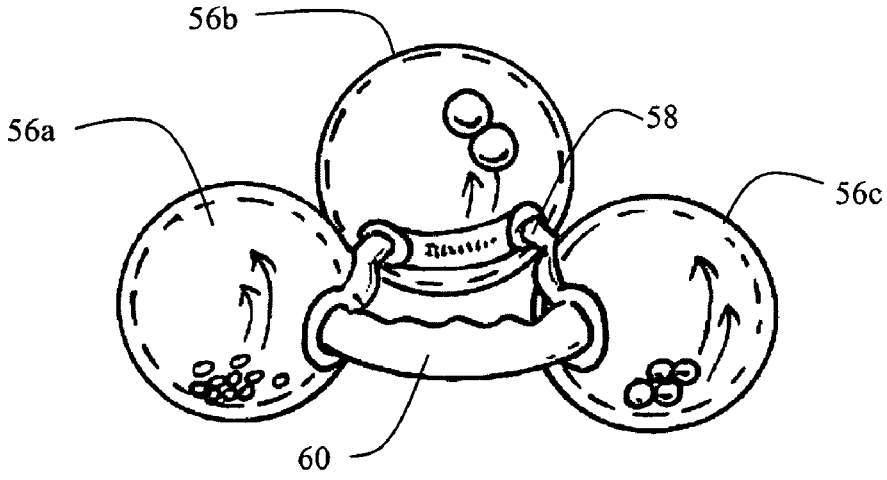
FIG. 8B is a phantom view of triple embodiment of using three elements as shown in FIGS. 3A and 3B.

Additional complexity of sound may be created by interconnecting multiple separate instruments of the embodiments disclosed for simultaneous actuation. FIGS. 8A-8D demonstrate exemplary embodiments of this type. FIG. 8A is a consolidated or conglomerate instrument employing three cylindrical instruments as described with respect to FIG. 1. Each of the units has a case 10*d*, 10*e* and 10*f* carrying balls 14*d*, 14*e* and 14*f* having varying diameter and number. Interconnecting frame 54 attaches the three cases together. The embodiment shown in the drawings provides a handle 55 in one web of the frame, however, in alternative embodiments, the webs may be of identical shape. FIG. 8B shows a similar embodiment with three interconnected spherical instruments 56*a*, 56*b* and 56*c* each as previously described with respect to FIGS. 3A and 3B interconnected with a frame 58 having a handle 60. As with the embodiment described in FIG. 8A, the frame and handle arrangement may be altered to suit potential playing styles or usage.

Figure 8C:
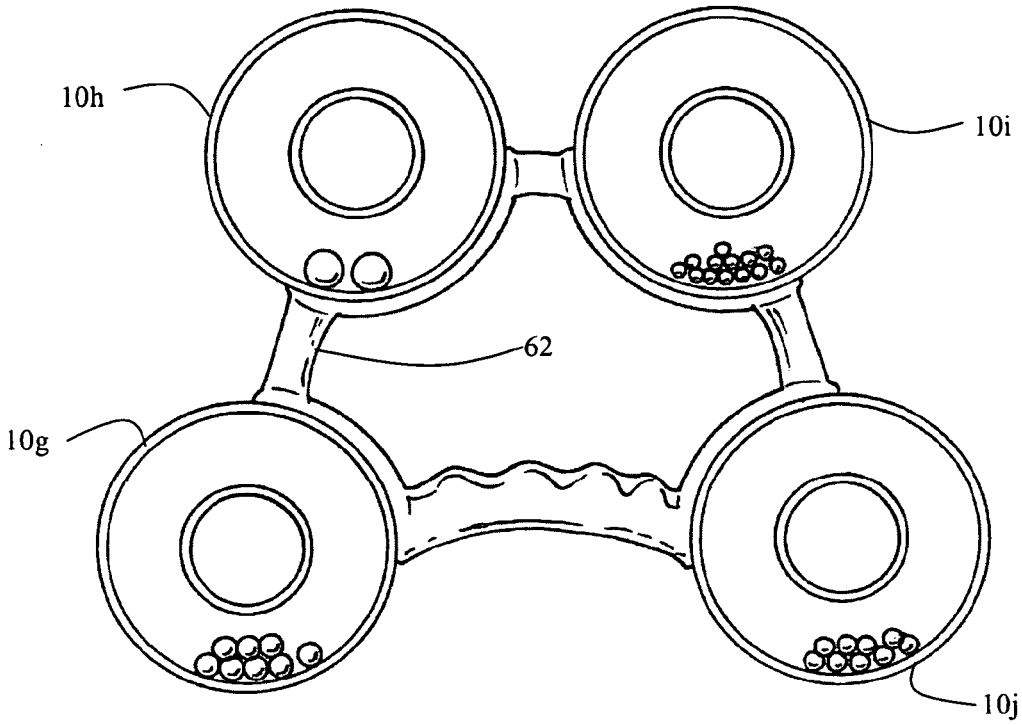
FIG. 8C is a side section view of four of the embodiments in FIG. 2A attached together as a single unit; and, FIG. 8D is a phantom view of four unit embodiment of FIG. 8C.
Figure 8D:
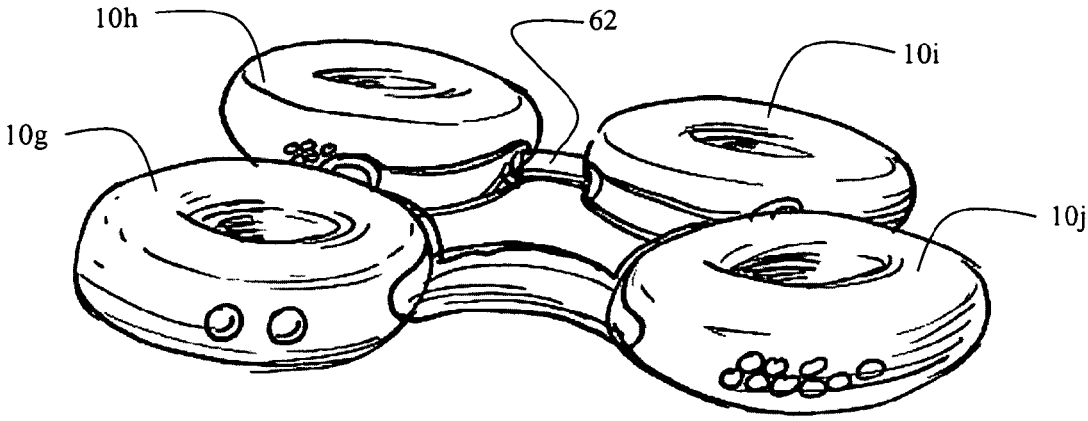

FIGS. 8C and 8D show an alternative embodiment employing four instruments of torroidal shape as described with respect to FIGS. 2A through 2D. The torroidal cases, 10*g*, 10*h*, 10*i* and 10*j* are interconnected with a frame 62. As described for the embodiments of FIGS. 8A and 8B, the balls in the torroidal cases may be of varying size and number. Additionally, the material of the torroids may be different providing a highly complex sound from the instrument.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A percussion instrument comprising:

a sphere having hemispheres of two different materials and having an inner surface with a substantially circular profile, the case inner surface having a first texture on a first portion of the inner surface and a second texture on a second portion of the inner surface;

a plurality of high precision spherical balls, contained within the case for acceleration on the inner surface in free uniform circular motion along the profile to produce a persistent sustained sound, said case having a radius sufficient to induce uniform circular motion of the balls.

2. A percussion instrument comprising:

at least three separated percussion chambers each having a case having an inner surface with a substantially circular profile, the cases of the chambers selected from the set of torroidal and spherical shapes and interconnected by a frame having a plurality of webs arcuately extending between the chambers;

at least one high precision spherical ball contained within the case for acceleration on the inner surface in uniform circular motion along the profile to produce a persistent sustained sound.

3. The percussion instrument comprising:

three separated percussion chambers interconnected by a frame having a plurality of webs arcuately extending between the chambers, each chamber having a case having an inner surface with a substantially circular profile and a plurality of high precision spherical balls contained within the cases for acceleration on the inner surface in uniform circular motion along the profile to produce a persistent sustained sound.

4. The percussion instrument as defined in claim 3 wherein one arcuate web comprises a handle with grooves and protrusions to firmly grip a users fingers.

5. The percussion instrument as defined in claim 3 wherein a first case has a first ball size, a second case has a second ball size and a third case has a third ball size.

* * * * *